US008500243B2

(12) United States Patent
Yamamoto

(10) Patent No.: US 8,500,243 B2
(45) Date of Patent: Aug. 6, 2013

(54) INKJET HEAD AND METHOD OF MANUFACTURING INKJET HEAD

(75) Inventor: Keizaburo Yamamoto, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 339 days.

(21) Appl. No.: 13/036,967

(22) Filed: Feb. 28, 2011

(65) Prior Publication Data

US 2012/0038710 A1 Feb. 16, 2012

(30) Foreign Application Priority Data

Aug. 11, 2010 (JP) ..... 2010-180596

(51) Int. Cl.
*B41J 2/15* (2006.01)
*B41J 2/145* (2006.01)

(52) U.S. Cl.
USPC ..... 347/40; 347/71

(58) Field of Classification Search
USPC ..... 347/9, 12, 40, 42–44, 47–49, 65–68, 347/71
See application file for complete search history.

(56) References Cited

U.S. PATENT DOCUMENTS 5,929,881 A * 7/1999 Kitahara et al. ..... 347/70
7,658,461 B2 * 2/2010 Ito ..... 347/17
2008/0239004 A1 10/2008 Iwanaga et al.

FOREIGN PATENT DOCUMENTS

JP 2001-179992 7/2001
JP 2009-180822 7/2009
WO WO-2007/113554 A2 10/2007

* cited by examiner

*Primary Examiner* — Thinh Nguyen
(74) *Attorney, Agent, or Firm* — Patterson & Sheridan, L.L.P.

(57) ABSTRACT

According to one embodiment, an inkjet head includes a nozzle plate, a base member, a frame-like member, an ink chamber, a supply channel and a discharge channel. The nozzle plate includes nozzles. The base member includes driving elements that cause the ink to be ejected from the nozzles, and is opposed to the nozzle plate. The frame-like member is interposed between the nozzle plate and the base member and includes first opening parts and a second opening part extending over all the first opening parts. The ink chamber is provided inside the frame-like member and communicates with the ink chamber. The supply channel is provided in the base member and communicates with the ink chamber to supply ink. The discharge channel is provided in the base member, communicates with the ink chamber to discharge ink, and is connected to the first opening parts through the second opening parts.

16 Claims, 15 Drawing Sheets

INKJET HEAD AND METHOD OF MANUFACTURING INKJET HEAD

CROSS-REFERENCE TO RELATED APPLICATIONS

This application is based upon and claims the benefit of priority from Japanese Patent Application No. 2010-180596, filed on Aug. 11, 2010; the entire contents of which are incorporated herein by reference.

FIELD

Embodiments described herein relate generally to an inkjet head and a method of manufacturing an inkjet head.

BACKGROUND

Some of inkjet printers have a structure of circulating ink through an inkjet head thereof. Inkjet heads of this type include a substrate, a frame-like member attached to the substrate, and a nozzle plate attached to the frame-like member.

The substrate, the frame-like member, and the nozzle plate form an ink chamber inside the inkjet head. A plurality of driving elements are attached to the substrate such that the driving elements are arranged in the ink chamber. The driving elements eject ink which is supplied to the ink chamber from nozzles provided on the nozzle plate.

The substrate comprises a plurality of supply ports to supply ink to the ink chamber, and a plurality of discharge ports to discharge ink from the ink chamber. The driving elements are arranged between the supply ports and the discharge ports. The ink supplied from the supply ports to the ink chamber is ejected from the nozzles of the inkjet head by the driving elements. The remaining ink is recovered from the discharge ports into the ink tank.

The substrate comprises wire which applies voltage to the driving elements. The wire is provided to avoid the discharge ports and the supply ports. Therefore, the wire is complicatedly arranged on the substrate, and manufacturing of the inkjet head becomes difficult.

DETAILED DESCRIPTION

In general, according to one embodiment, an inkjet head includes a nozzle plate, a base member, a frame-like member, an ink chamber, a supply channel and a discharge channel. The nozzle plate includes nozzles. The base member includes driving elements that cause the ink to be ejected from the nozzles, and is opposed to the nozzle plate. The frame-like member is interposed between the nozzle plate and the base member and includes first opening parts and a second opening part extending over all the first opening parts. The ink chamber is provided inside the frame-like member and communicates with the ink chamber. The supply channel is provided in the base member and communicates with the ink chamber to supply ink. The discharge channel is provided in the base member, communicates with the ink chamber to discharge ink, and is connected to the first opening parts through the second opening parts.

Figure 1:
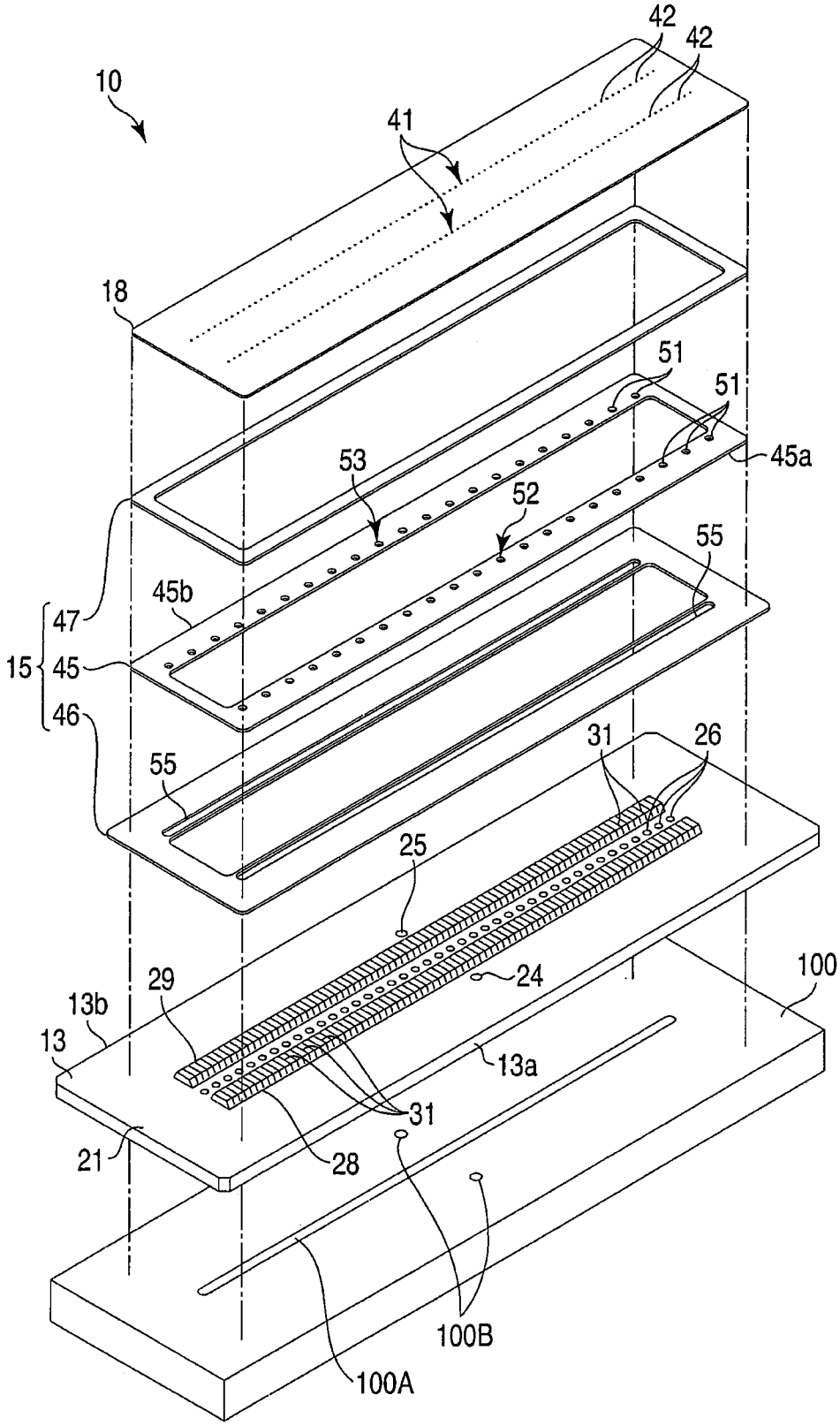
FIG. 1 is an exploded perspective view of an inkjet head according to a first embodiment.
Figure 2:
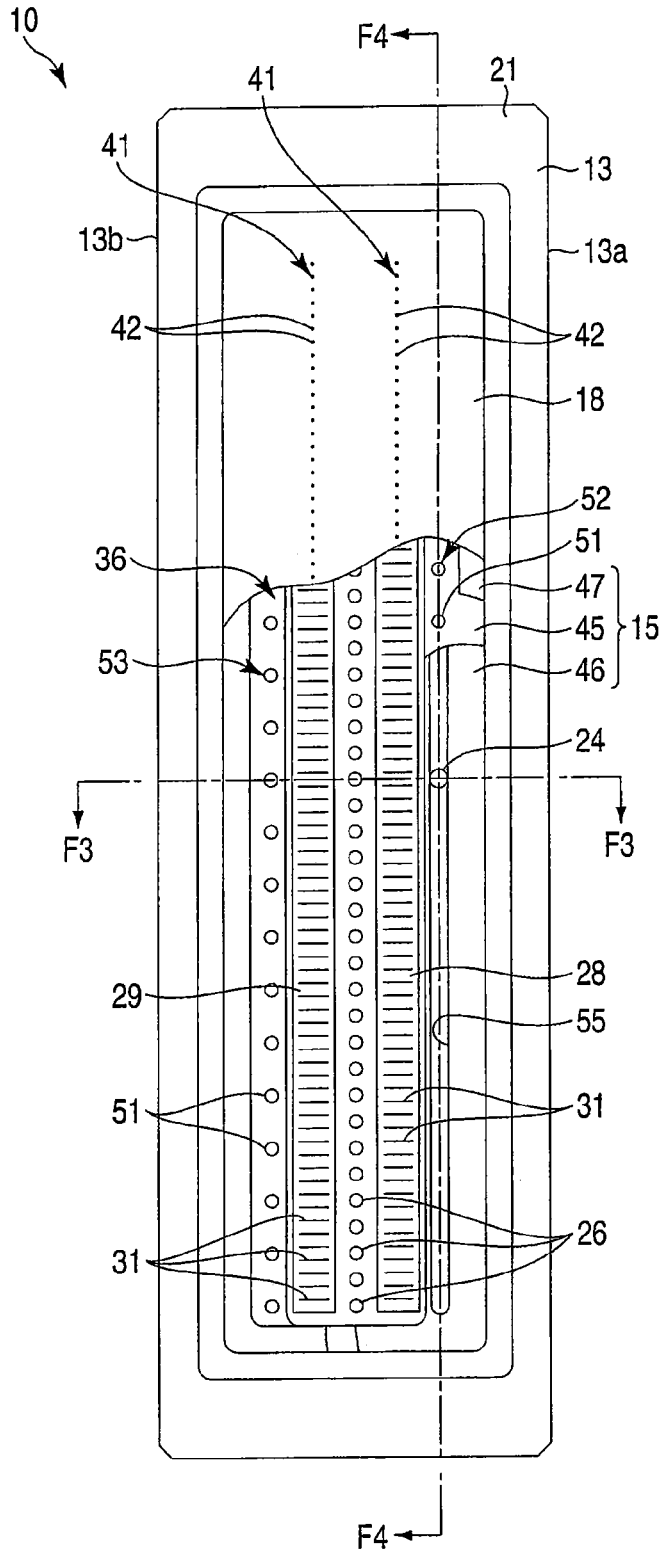
FIG. 2 is a plan view of the inkjet head of the first embodiment, part of which is cut away.

A first embodiment will be explained hereinafter with reference to FIG. 1 to FIG. 5. FIG. 1 is an exploded perspective view of an inkjet head 10. FIG. 2 is a plan view of the inkjet head 10, part of which is cut away. As illustrated in FIG. 1, the inkjet head 10 comprises a substrate 13, a frame-like member 15, and a nozzle plate 18. The substrate 13 is an example of a base member.

Figure 3:
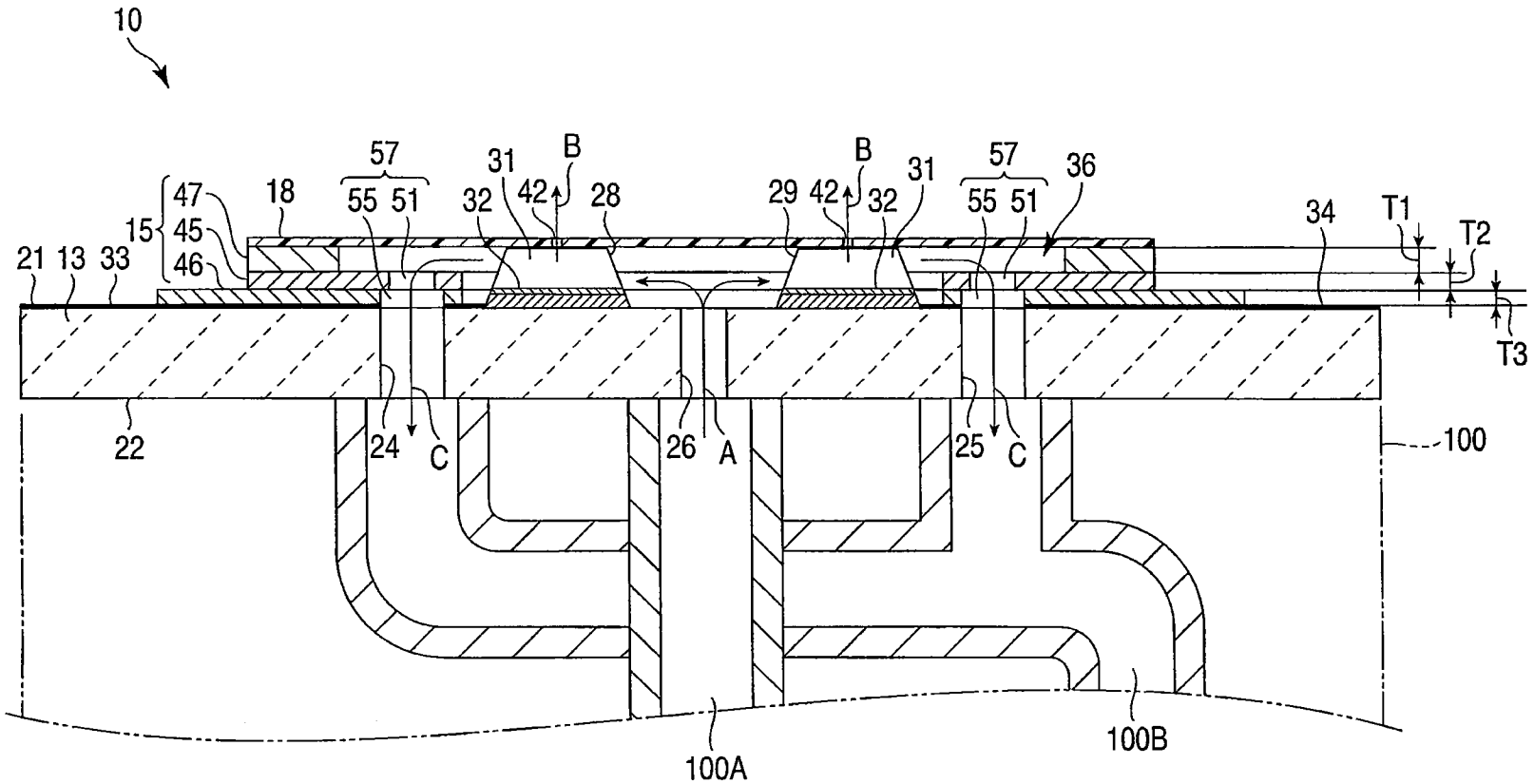
FIG. 3 is a cross-sectional view of the inkjet head of the first embodiment, taken along line F3-F3 of FIG. 2.
Figure 4:
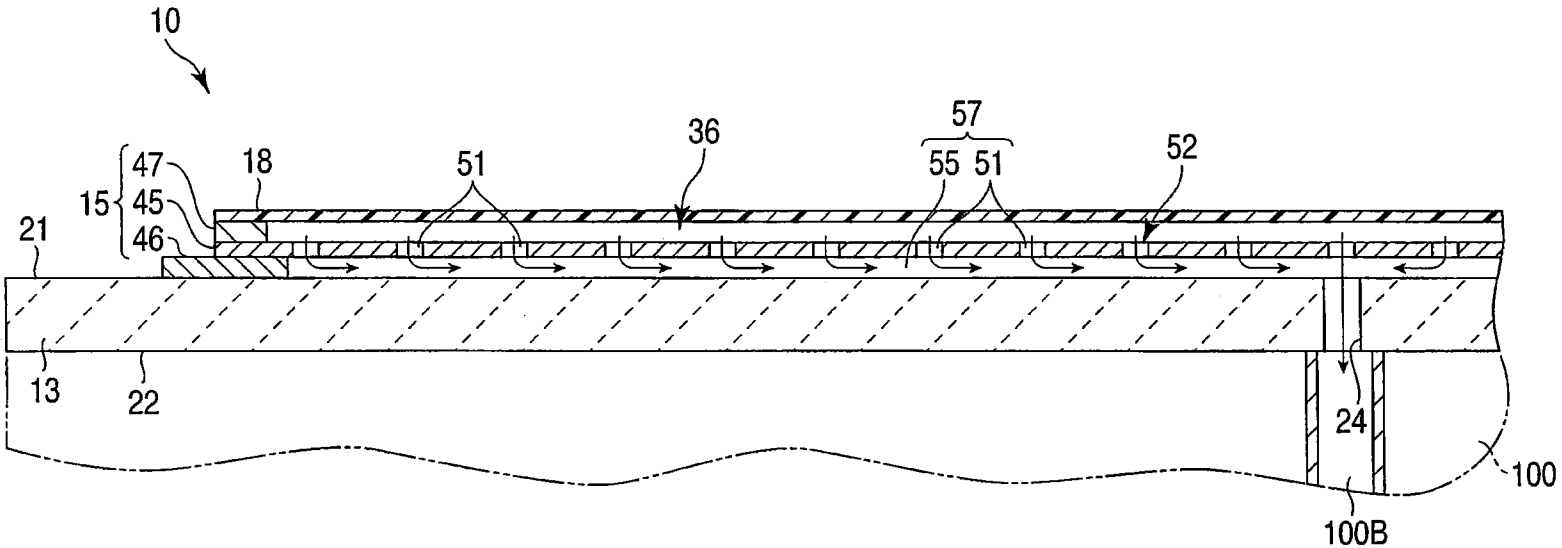
FIG. 4 is a cross-sectional view of the inkjet head of the first embodiment, taken along line F4-F4 of FIG. 2.

FIG. 3 is a cross-sectional view of the inkjet head 10, taken along line F3-F3 of FIG. 2. FIG. 4 is a cross-sectional view of the inkjet head 10, taken along line F4-F4 of FIG. 2. The substrate 13 is formed of ceramics such as alumina, in a rectangular shape. As illustrated in FIG. 3, the substrate 13 has a first surface 21 and a second surface 22 which is located opposite to the first surface 21. A manifold 100 is attached to the second surface 22. The manifold 100 comprises an ink supply part 100A and an ink discharge part 100B. The manifold 100 supplies ink to the inkjet head 10, and discharges ink which remains in the inkjet head 10.

As illustrated in FIG. 1, the substrate 13 comprises a first discharge port 24, a second discharge port 25, and a plurality of supply ports 26. The first discharge port 24 and the second discharge port 25 are an example of a discharge channel provided in the base member. The supply ports 26 are an example of a supply channel provided in the base member. The first discharge port 24 and the second discharge port 25 are formed larger in size than the supply ports 26.

The supply ports 26 are arranged in a line in a longitudinal direction of the substrate 13, in a center part in a width direction of the substrate 13. When the inkjet head 10 is attached to the manifold 100, the supply ports 26 are connected to an ink tank of an inkjet printer through the ink supply part 100A.

The first discharge port 24 is disposed between the supply ports 26 and one side edge 13*a* of the substrate 13. The second discharge port 25 is disposed between the supply ports 26 and the other side edge 13*b* of the substrate 13. The supply ports 26 are between the first discharge port 24 and the second discharge port 25. When the inkjet head 10 is attached to the manifold 100, the first discharge port 24 and the second discharge port 25 are connected to the ink tank through the ink discharge part 100B.

The substrate 13 comprises a first piezoelectric member 28 and a second piezoelectric member 29. The first and the second piezoelectric members 28 and 29 are attached to the first surface 21 of the substrate 13 by bonding. The first piezoelectric member 28 is disposed between the first discharge port 24 and the supply ports 26. The second piezoelectric member 29 is disposed between the second discharge port 25 and the supply ports 26. The first piezoelectric member 28 and the second piezoelectric member 29 are arranged in parallel with each other.

Each of the first and the second piezoelectric members 28 and 29 is formed of two piezoelectric plates which are bonded to each other and formed of lead zirconate titanate (PZT). The two piezoelectric plates have opposed polarization directions. As illustrated in FIG. 3, each of the first and the second piezoelectric members 28 and 29 is formed in a bar shape which has a trapezoidal cross section.

Each of the first and the second piezoelectric members 28 and 29 comprises a plurality of groove parts 31 for ink ejection. The groove parts 31 are an example of driving elements. As illustrated in FIG. 2, the groove parts 31 are arranged side by side in a direction in which the first and the second piezoelectric members 28 and 29 extend. The groove parts 31 extend in a direction crossing the direction in which the first and the second piezoelectric members 28 and 29 extend. As illustrated in FIG. 3, an electrode 32 is formed on a bottom part and side parts of each groove part 31.

Figure 5:
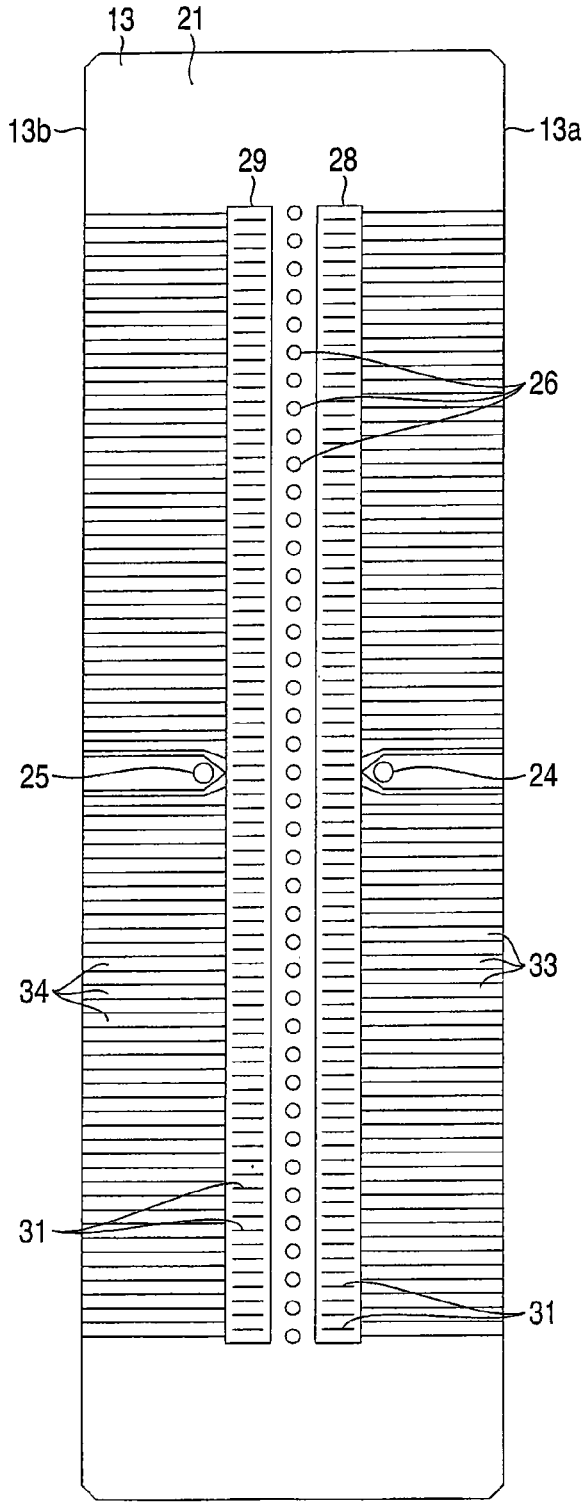
FIG. 5 is a plan view illustrating a substrate of the first embodiment.

FIG. 5 is a plan view of the substrate 13. As illustrated in FIG. 5, a plurality of first wires 33 and a plurality of second wires 34 are formed on the first surface 21 of the substrate 13. The first wires 33 are formed to extend from one side edge 13*a* of the substrate 13 to the first piezoelectric member 28. Some of the first wires 33 are provided to avoid the first discharge port 24. The second wires 34 are formed to extend from the other side edge 13*b* of the substrate 13 to the second piezoelectric member 29. Some of the second wires 34 are provided to avoid the second discharge port 25.

One ends of the first and the second wires 33 and 34 are connected to the electrodes 32. The other ends of the first and the second wires 33 and 34 are connected to, for example, a head driving IC.

As illustrated in FIG. 1, the frame-like member 15 is interposed between the substrate 13 and the nozzle plate 18. The frame-like member 15 is bonded to the substrate 13 with no space therebetween. The frame-like member 15 surrounds the first and the second piezoelectric members 28 and 29 and the supply ports 26.

The nozzle plate 18 is opposed to the substrate 13. The nozzle plate 18 is bonded to an upper part of a spacer 47 of the frame-like member 15 with no space therebetween. The nozzle plate 18 is formed of a rectangular polyimide film. As illustrated in FIG. 3, an ink chamber 36 is provided inside the substrate 13, the frame-like member 15, and the nozzle plate 18.

As illustrated in FIG. 1, the nozzle plate 18 comprises a pair of nozzle lines 41. Each of the nozzle lines 41 includes a plurality of nozzles 42. As illustrated in FIG. 3, the nozzles 42 correspond to the respective groove parts 31.

As illustrated in FIG. 1, the frame-like member 15 comprises a first plate 45, a second plate 46, and the spacer 47. Each of the first plate 45, the second plate 46, and the spacer 47 is formed in a frame shape.

The frame-like member 15 is formed by uniting the first plate 45 with the second plate 46 and the spacer 47. The second plate 46 is bonded to the substrate 13. The spacer 47 is bonded to the nozzle plate 18.

The first plate 45 comprises a plurality of first opening parts 51. The first opening parts 51 are arranged in two lines, and form a first opening line 52 and a second opening line 53. The first opening line 52 is provided along one side edge 45*a* of the first plate 45. The second opening line 53 is provided along the other side edge 45*b* of the first plate 45. As illustrated in FIG. 3, each of the first opening parts 51 communicates with the ink chamber 36.

In the first opening line 52, each first opening part 51 is provided to correspond to, for example, twenty groove parts 31 of the first piezoelectric member 28. In the second opening line 53, each first opening part 51 is provided to correspond to, for example, twenty groove parts 31 of the second piezoelectric member 29. The first plate 45 which comprises the first opening parts 51 having the above structure is formed by etching, for example, a plate formed of nickel alloy.

As illustrated in FIG. 1, the second plate 46 comprises a pair of second opening parts 55. One of the second opening parts 55 is formed with a large length to extend over all the first opening parts 51 included in the first opening line 52. The other second opening part 55 is formed with a large length to extend over all the first opening parts 51 included in the second opening line 53.

As illustrated in FIG. 4, one second opening part 55 connects all the first opening parts 51 included in the first opening line 52 with the first discharge port 24. The other second opening part 55 connects all the first opening parts 51 included in the second opening line 53 with the second discharge port 25. The second plate 46 which comprises the second opening parts 55 having the above structure is formed by etching, for example, a plate formed of nickel alloy.

The first opening parts 51 and the second opening parts 55 form a pair of first branch channels 57 inside the frame-like member 15. In other words, the first opening parts 51 and the second opening parts 55 form a pair of first branch channels 57 within a range of the thickness of the frame-like member 15. The first branch channels 57 are provided in the frame-like member 15, and include the first opening parts 51 and the second opening parts 55. One of the first branch channels 57 connects the first discharge port 24 with the ink chamber 36. The other first branch channel 57 connects the second discharge port 25 with the ink chamber 36.

As illustrated in FIG. 2, the spacer 47 surrounds the first opening parts 51. As illustrated in FIG. 3, thickness T1 of the spacer 47 is larger than thickness T2 of the first plate 45. The thickness T1 of the spacer 47 is larger than thickness T3 of the second plate 46. The spacer 47 having the above structure is formed by etching, for example, a plate formed of nickel alloy. The thickness of the spacer 47 is not limited to the above. The spacer 47 is formed to reduce channel resistance at the time when the ink flows.

The material of the first plate 45, the second plate 46, and the spacer 47 are not limited to nickel alloy, but they may be formed of metal or resin, such as stainless and ceramics. In addition, processing of the first plate 45, the second plate 46, and the spacer 47 are not limited to etching, but they may be formed by machining, punching, or laser processing.

The inkjet head 10 having the above structure is attached to the manifold 100 of an inkjet printer, and used for printing. In printing processing, ink is supplied from an ink tank to the inkjet head 10. As indicated by arrow A in FIG. 3, the ink of the ink tank is supplied into the ink chamber 36 through the supply ports 26 which communicates with the ink chamber 36. The ink is filled into each of the groove parts 31 of the first and the second piezoelectric members 28 and 29.

When the user instructs the printer to print, a control module of the printer outputs a printing signal to the head driving IC. The head driving IC which has received the printing signal applies a driving pulse voltage to the electrodes 32 through the first and the second wires 33 and 34. The groove parts 31 perform share mode deformation and spread, in accordance with the applied voltage. Thereafter, the groove parts 31 return to their original positions, and the pressure in each groove part 31 increases. Thereby, the groove parts 31 eject ink from the respective nozzles 42 in a direction indicated by arrow B in FIG. 3.

The ink which is left over in the ink chamber 36 is discharged from the first discharge port 24 through one first branch channel 57, as indicated by arrow C in FIG. 3. In the same manner, the ink which is left over is also discharged from the second discharge port 25 through the other first branch channel 57. Each of the first discharge port 24 and the second discharge port 25 communicates with the ink chamber 36. The flow of ink on the side of the first discharge port 24 will be explained hereinafter. The flow of ink on the side of the second discharge port 25 is the same as the flow of ink on the side of the first discharge port 24.

Ink flows from the groove parts 31 of the first piezoelectric member 28 into the corresponding first opening parts 51 of the first opening line 52. Since the spacer 47 is formed thicker than the first and the second plates 45 and 46, the ink smoothly flows into the first opening parts 51. As illustrated in FIG. 4, ink streams which have run into the respective first opening parts 51 meet each other through the second opening part 55. Then, the ink flows out of the first discharge port 24. The ink which has flowed out of the first discharge port 24 is recovered and returned to the ink tank.

Next, a process of manufacturing the inkjet head 10 having the above structure will be explained hereinafter. First, the first discharge port 24, the second discharge port 25, and the supply ports 26 are formed by press formation in the substrate 13 which is formed of ceramics sheet (ceramics green sheet) before sintering. Then, the substrate 13 is sintered.

Next, the first piezoelectric member 28 and the second piezoelectric member 29 are bonded to the substrate 13. In bonding, a distance between the first and the second piezoelectric members 28 and 29 is maintained at a fixed distance by a jig (not shown). In addition, the first and the second piezoelectric members 28 and 29 are positioned to the substrate 13 by the jig, and bonded to the substrate 13.

Next, the first and the second piezoelectric members 28 and 29 bonded to the substrate 13 are tapered. In tapering, corner parts of the first and the second piezoelectric members 28 and 29 are subjected to grinding or machining. A plurality of groove parts 31 are formed in each of the first and the second piezoelectric members 28 and 29. This processing is performed with, for example, diamond wheels of a dicing saw which is used for cutting IC wafers.

Next, the electrodes 32 are formed on respective internal surfaces of the groove parts 31, and a plurality of first wires 33 and a plurality of second wires 34 are formed on the substrate 13. The electrodes 32 and the first and the second wires 33 and 34 are formed of, for example, a nickel thin film which is formed by non-electrolyte plating. Thereafter, patterning is performed by laser irradiation, and thereby the nickel thin film is removed from parts other than the electrodes 32, the first wires 33, and the second wires 34.

Then, the frame-like member 15 is formed. First, the first plate 45 is put on the second plate 46. The first and the second plates 45 and 46 are arranged such that one second opening part 55 extends over all the first opening parts 51 of the first opening line 52, and the other second opening part 55 extends over all the first opening parts 51 of the second opening line 53. The spacer 47 is put on the first plate 45, such that the spacer 47 surrounds the first opening parts 51. Then, the first plate 45, the second plate 46, and the spacer 47 which are stacked up are bonded to each other.

Bonding is performed by, for example, diffusion bonding. Specifically, the first plate 45, the second plate 46, and the spacer 47 which are stacked up are heated and pressurized in a high vacuum without melting them. Thereby, atoms of a bonding interface between the first plate 45 and the second plate 46 and a bonding interface between the first plate 45 and the spacer 47 diffuse, and the first plate 45, the second plate 46, and the spacer 47 are bonded to each other. The method of bonding them is not limited to diffusion bonding, but other bonding methods such as anode bonding and other vacuum bonding may be used.

Thereafter, the formed frame-like member 15 is bonded to the substrate 13. The nozzle plate 18 is bonded to the frame-like member 15. A plurality of nozzles 42 are formed by irradiating the nozzle plate 18 with laser light, and thereby the manufacturing process of the inkjet head 10 is finished.

According to the inkjet head 10 having the above structure, the substrate 13 comprises one first discharge port 24 and one second discharge port 25. The first discharge port 24 is branched by the first branch channel 57 and connected to the ink chamber 36. The second discharge port 25 is also branched by the first branch channel 57, and connected to the ink chamber 36. As described above, even in the case where a plurality of openings for discharging ink are provided in the ink chamber 36, it suffices to provide one first discharge port 24 and one second discharge port 25 in the substrate 13.

Thereby, the number of holes provided in the substrate 13 is reduced. Reducing the holes of the substrate 13 prevents the substrate 13 from cracking, and facilitates arranging other structural elements such as the first wires 33 and the second wires 34 on the substrate 13. As described above, the inkjet head 10 can be easily manufactured. Therefore, the processing cost of the inkjet head 10 is reduced.

In addition, the first opening parts 51 which correspond to the groove parts 31 are opened to the ink chamber 36. Thereby, the remaining ink uniformly flows into the first opening parts 51, thereby the ink is prevented from stagnating, and unevenness in density in printing is prevented.

In addition, the frame-like member 15 is formed by bonding the first plate 45, the second plate 46, and the spacer 47. Thereby, the frame-like member 15 which comprises the first branch channels 57 is easily manufactured.

Next, a second embodiment will be explained hereinafter with reference to FIG. 6 to FIG. 9. Constituent elements having the same functions as those of the inkjet head 10 of the first embodiment are denoted by the same respective reference numerals, and explanation thereof is omitted.

Figure 6:
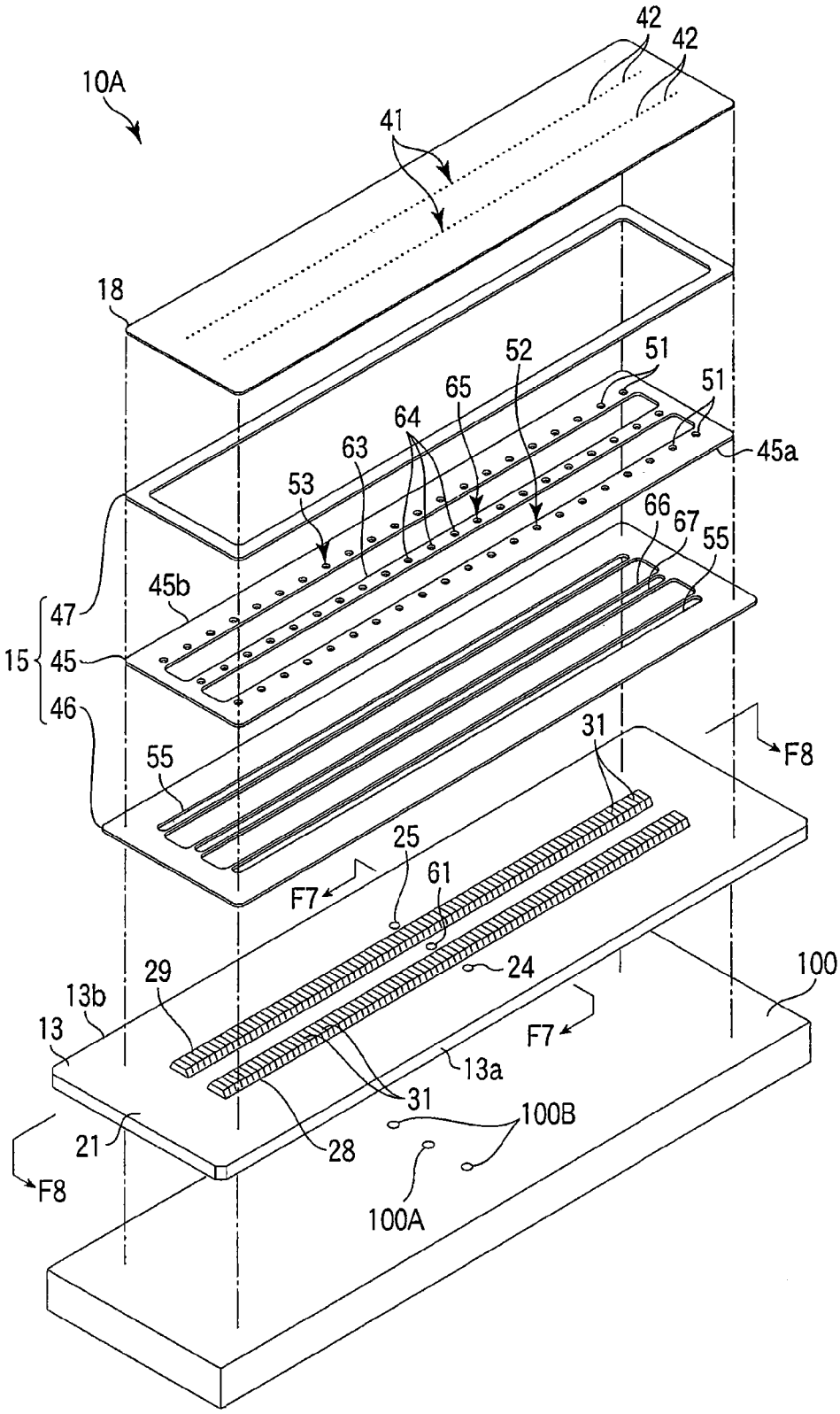
FIG. 6 is an exploded perspective view of an inkjet head according to a second embodiment.
Figure 7:
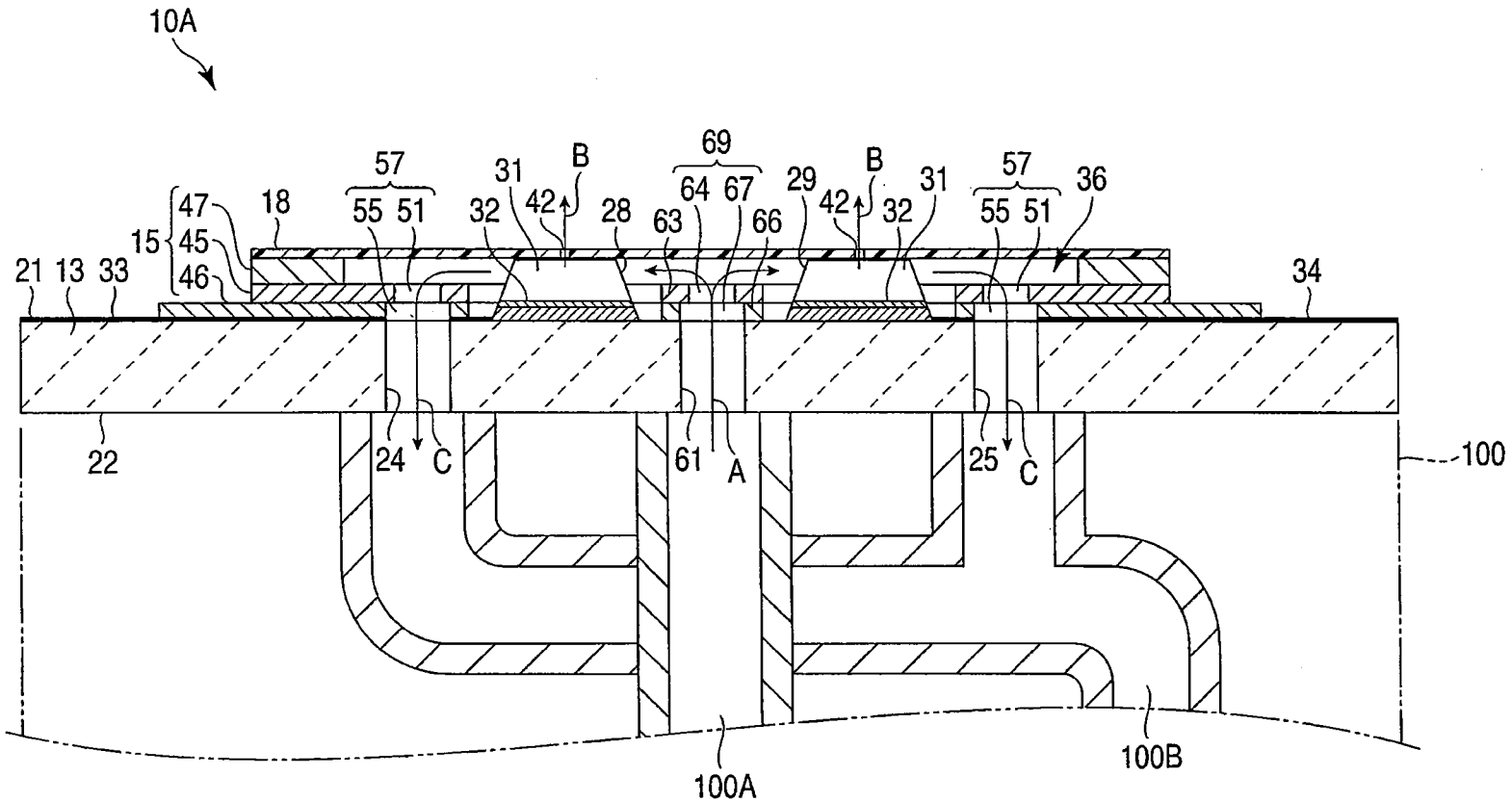
FIG. 7 is a cross-sectional view of the inkjet head of the second embodiment, taken along line F7-F7 of FIG. 6.
Figure 8:
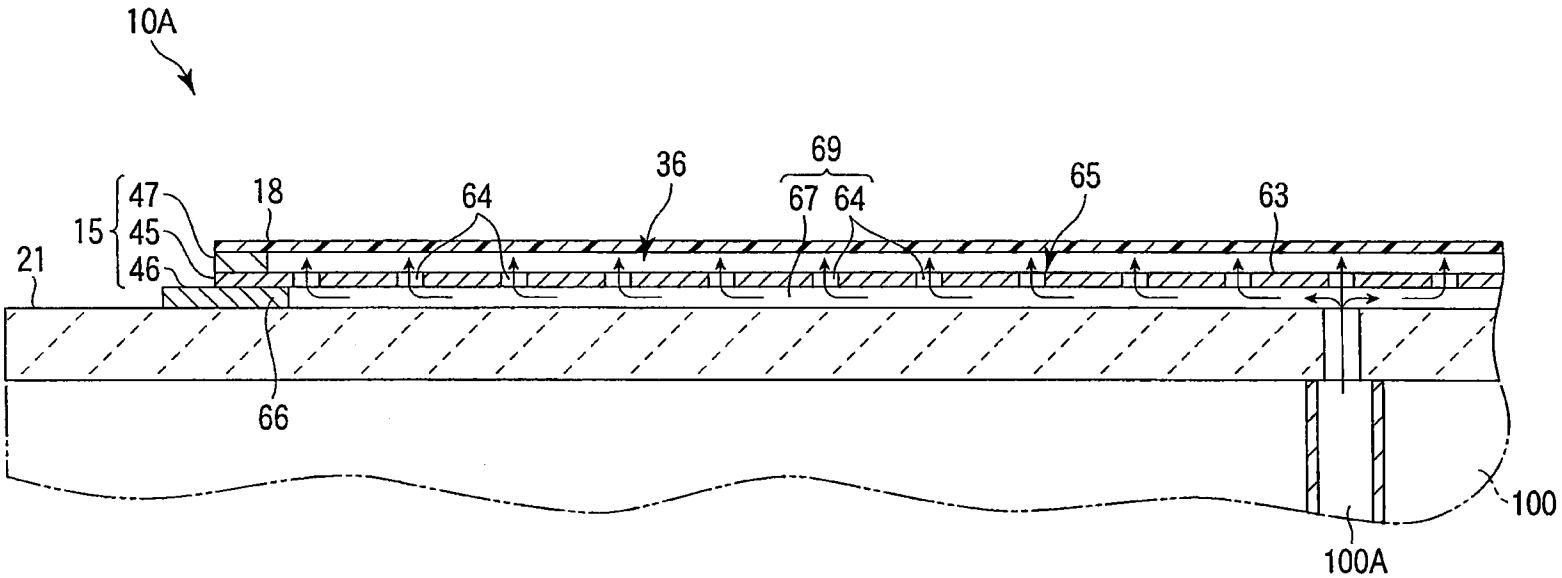
FIG. 8 is a cross-sectional view of the inkjet head of the second embodiment, taken along line F8-F8 of FIG. 6.

FIG. 6 is an exploded perspective view of an inkjet head 10A of the second embodiment. FIG. 7 is a cross-sectional view of the inkjet head 10A, taken along line F7-F7 of FIG. 6. FIG. 8 is a cross-sectional view of the inkjet head 10A, taken along line F8-F8 of FIG. 6. As illustrated in FIG. 6, a substrate 13 of the inkjet head 10A comprises one supply port 61 instead of a plurality of supply ports 26. The supply port 61 is an example of a supply channel provided in the base member.

The supply port 61 is provided in a center part of the substrate 13. When the inkjet head 10A is attached to a manifold 100, the supply port 61 is connected to an ink tank through an ink supply part 100A.

A first plate 45 comprises a first middle frame 63. The first middle frame 63 extends in a longitudinal direction of the first plate 45, in a center in a width direction of the first plate 45. As illustrated in FIG. 7, in a state where a frame-like member 15 is attached to the substrate 13, the first middle frame 63 is disposed between a first piezoelectric member 28 and a second piezoelectric member 29.

As illustrated in FIG. 6, the first plate 45 comprises a plurality of third opening parts 64 which are provided in the first middle frame 63. The third opening parts 64 are arranged in a line in a direction in which the first middle frame 63 extends, and form a third opening line 65. As illustrated in FIG. 7, each of the third opening parts 64 communicates with an ink chamber 36. In the third opening line 65, each third opening part 64 is provided to correspond to, for example, twenty groove parts 31 of the first piezoelectric member 28. The third opening parts 64 are formed smaller in size than the supply port 61.

As illustrated in FIG. 6, a second plate 46 comprises a second middle frame 66. The second middle frame 66 extends in a longitudinal direction of the second plate 46, in a center in a width direction of the second plate 46. As illustrated in FIG. 7, in a state where the frame-like member 15 is attached to the substrate 13, the second middle frame 66 is disposed between the first piezoelectric member 28 and the second piezoelectric member 29.

As illustrated in FIG. 6, the second plate 46 comprises a fourth opening part 67 which is provided in the second middle frame 66. The fourth opening part 67 is formed with a large length to cover all the third opening parts 64 included in the third opening line 65. As illustrated in FIG. 8, the fourth opening part 67 connects all the third opening parts 64 included in the third opening line 65 with the supply port 61.

The third opening parts 64 and the fourth opening part 67 form a second branch channel 69 inside the frame-like member 15. In other words, the third opening parts 64 and the fourth opening part 67 form the second branch channel 69 within a range of the thickness of the frame-like member 15. The second branch channel 69 is provided in the frame-like member 15, and includes the third opening parts 64 and the fourth opening part 67. The second branch channel 69 connects the supply port 61 with the ink chamber 36.

In the inkjet head 10A having the above structure, ink is supplied to the ink chamber 36 as follows. As indicated by arrow A in FIG. 7, ink in the ink tank is supplied to the ink chamber 36 through the second branch channel 69 from the supply port 61.

As illustrated in FIG. 8, the ink flows from the supply port 61 into the fourth opening part 67. The ink which has flowed into the fourth opening part 67 branches, and is supplied to the ink chamber 36 through the third opening parts 64.

According to the inkjet head 10A having the above structure, the substrate 13 comprises one supply port 61. The supply port 61 is branched by the second branch channel 69, and connected to the ink chamber 36. As described above, even when a plurality of openings for ink ejection are provided in the ink chamber 36, it suffices to provide one supply port 61 in the substrate 13. This structure further reduces the number of holes provided in the substrate 13, and thereby the inkjet head 10 is easily manufactured.

In addition, the third opening parts 64 which correspond to the groove parts 31 are opened to the ink chamber 36. Thereby, ink uniformly flows into the groove parts 31, and unevenness in density in printing is prevented.

Figure 9:
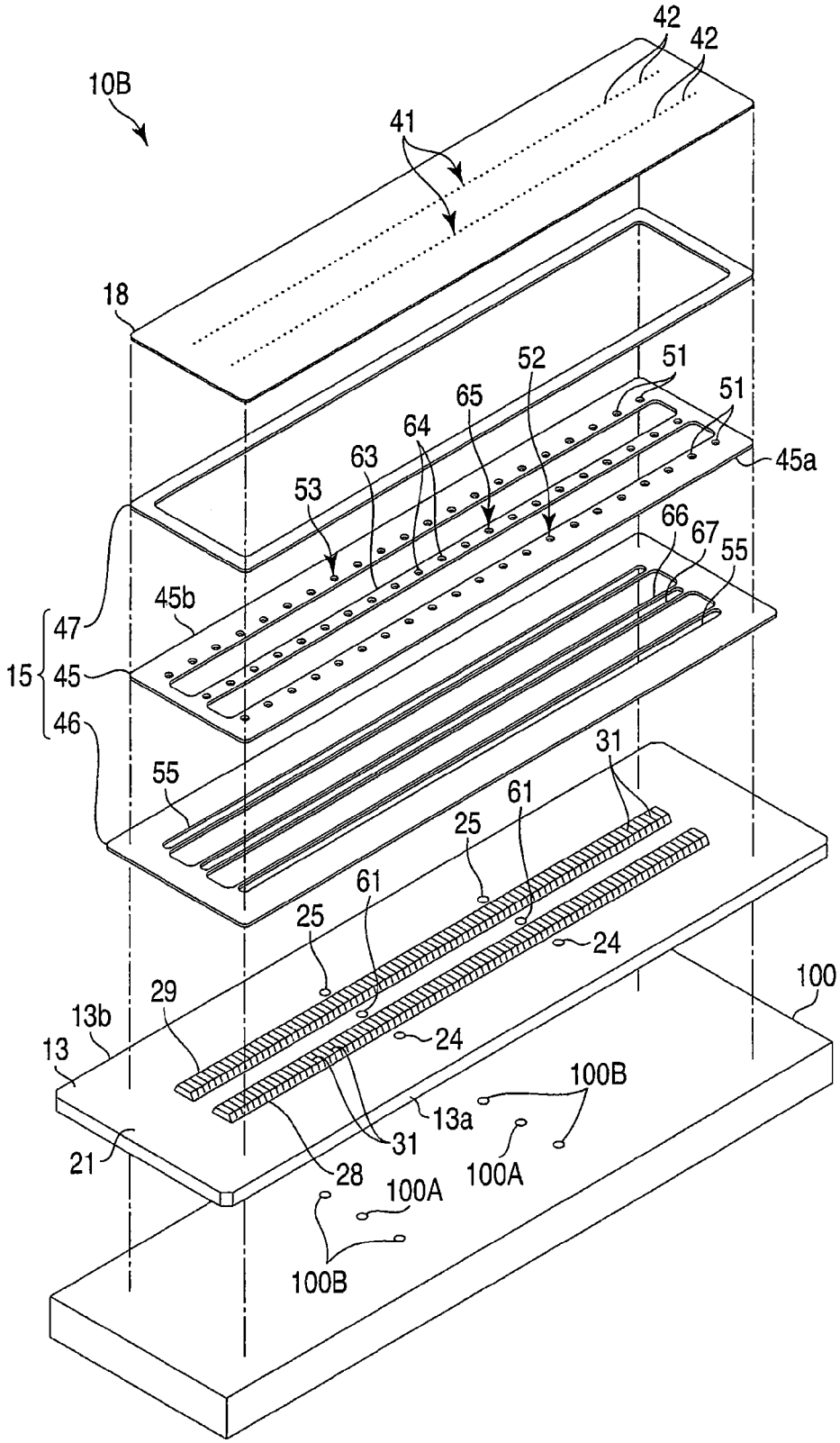
FIG. 9 is a perspective view illustrating a modification of the inkjet head of the second embodiment.

FIG. 9 is a perspective view of an inkjet head 10B which is a modification of the inkjet head 10A. As illustrated in FIG. 9, the substrate 13 may comprise a few first discharge ports 24, a few second discharge ports 25, and a few supply ports 61. In this case, the number of the first discharge port 24 is smaller than the number of the first opening parts 51 included in the first opening line 52. The number of the second discharge ports 25 is smaller than the number of the first opening parts 51 included in the second opening line 53. The number of the supply ports 61 is smaller than the number of the third opening parts 64.

Next, a third embodiment will be explained hereinafter with reference to FIG. 10 and FIG. 11. Constituent elements which have the same function as the inkjet head 10A of the second embodiment are denoted by the same respective reference numerals as those of the second embodiment, and explanation thereof is omitted.

Figure 10:
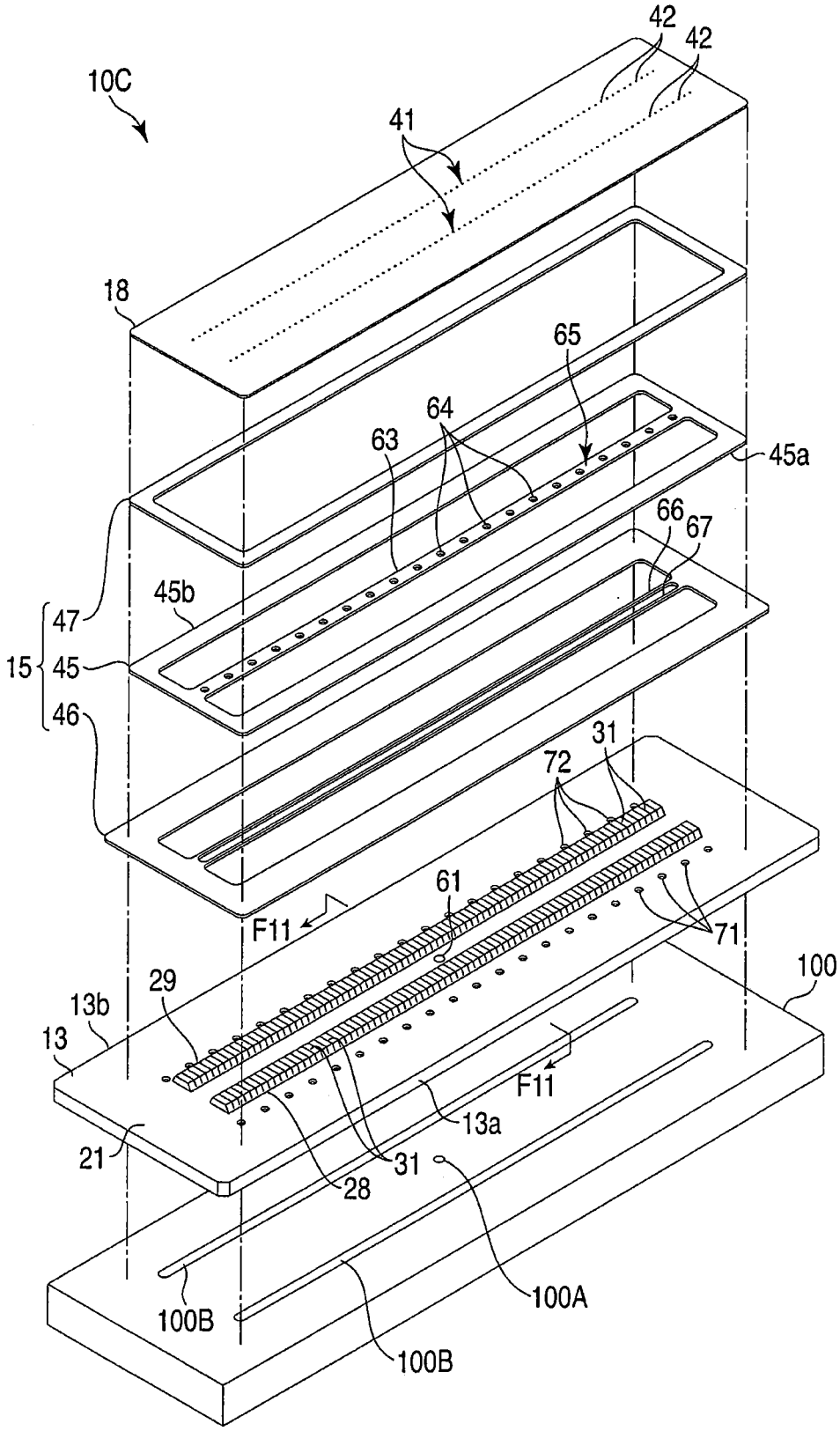
FIG. 10 is an exploded perspective view of an inkjet head according to a third embodiment.
Figure 11:
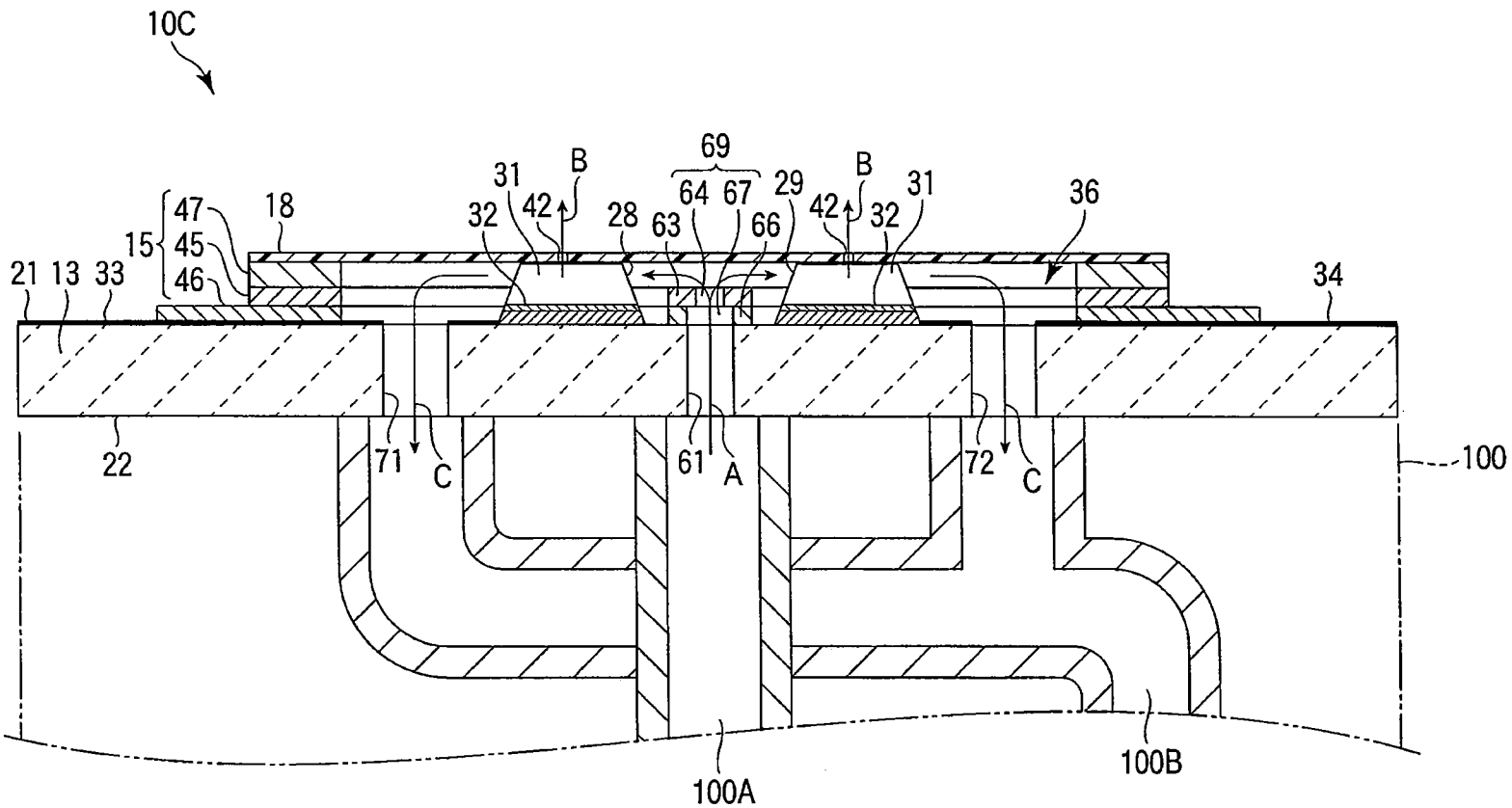
FIG. 11 is a cross-sectional view of the inkjet head of the third embodiment, taken along line F11-F11 of FIG. 10.

FIG. 10 is an exploded perspective view of an inkjet head 10C according to a third embodiment. FIG. 11 is a cross-sectional view of the inkjet head 10C, taken along line F11-F11 of FIG. 10. As illustrated in FIG. 10, a substrate 13 comprises a plurality of first discharge ports 71, instead of the first discharge port 24. In addition, the substrate 13 comprises a plurality of second discharge ports 72, instead of the second discharge port 25. The first discharge port 71 and the second discharge port 72 are an example of a discharge channel provided in the base member.

The first discharge ports 71 are disposed between a supply port 61 and one side edge 13*a* of the substrate 13. The first discharge ports 71 are arranged in a line in a longitudinal direction of the substrate 13. The second discharge ports 72 are arranged between the supply port 61 and the other side edge 13*b* of the substrate 13. The second discharge ports 72 are arranged in a line in a longitudinal direction of the substrate 13. The supply port 61 is between the first discharge ports 71 and the second discharge ports 72.

When the inkjet head 10C is attached to a manifold 100, the first discharge ports 71 and the second discharge ports 72 are connected to an ink tank through an ink discharge part 100B. As illustrated in FIG. 11, the first discharge ports 71 and the second discharge ports 72 are opened to the ink chamber 36. Therefore, the first discharge ports 71 and the second discharge ports 72 connect the ink tank with the ink chamber 36.

A first plate 45 comprises only a plurality of third opening parts 64. The first plate 45 surrounds the first discharge ports 71 and the second discharge ports 72. A second plate 46 comprises only a fourth opening part 67.

According to the inkjet head 100 having the above structure, the number of holes provided in the substrate 13 is reduced, and thereby the inkjet head 10C is easily manufactured.

Next, a fourth embodiment will be explained hereinafter with reference to FIG. 12 and FIG. 13. Constituent elements which have the same function as the inkjet head 100 of the third embodiment are denoted by the same respective reference numerals as those of the third embodiment, and explanation thereof is omitted.

Figure 12:
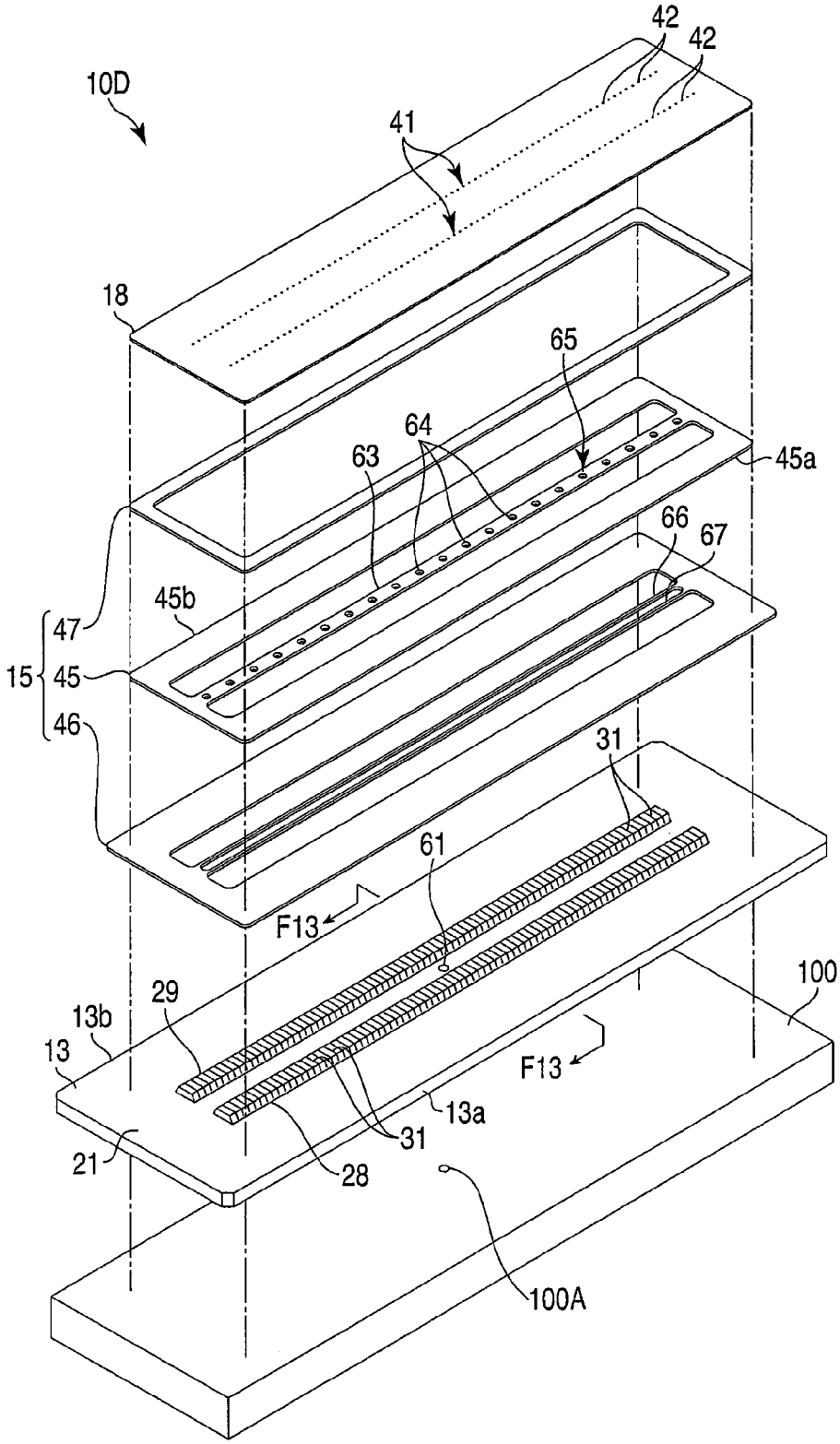
FIG. 12 is an exploded perspective view of an inkjet head according to a fourth embodiment.
Figure 13:
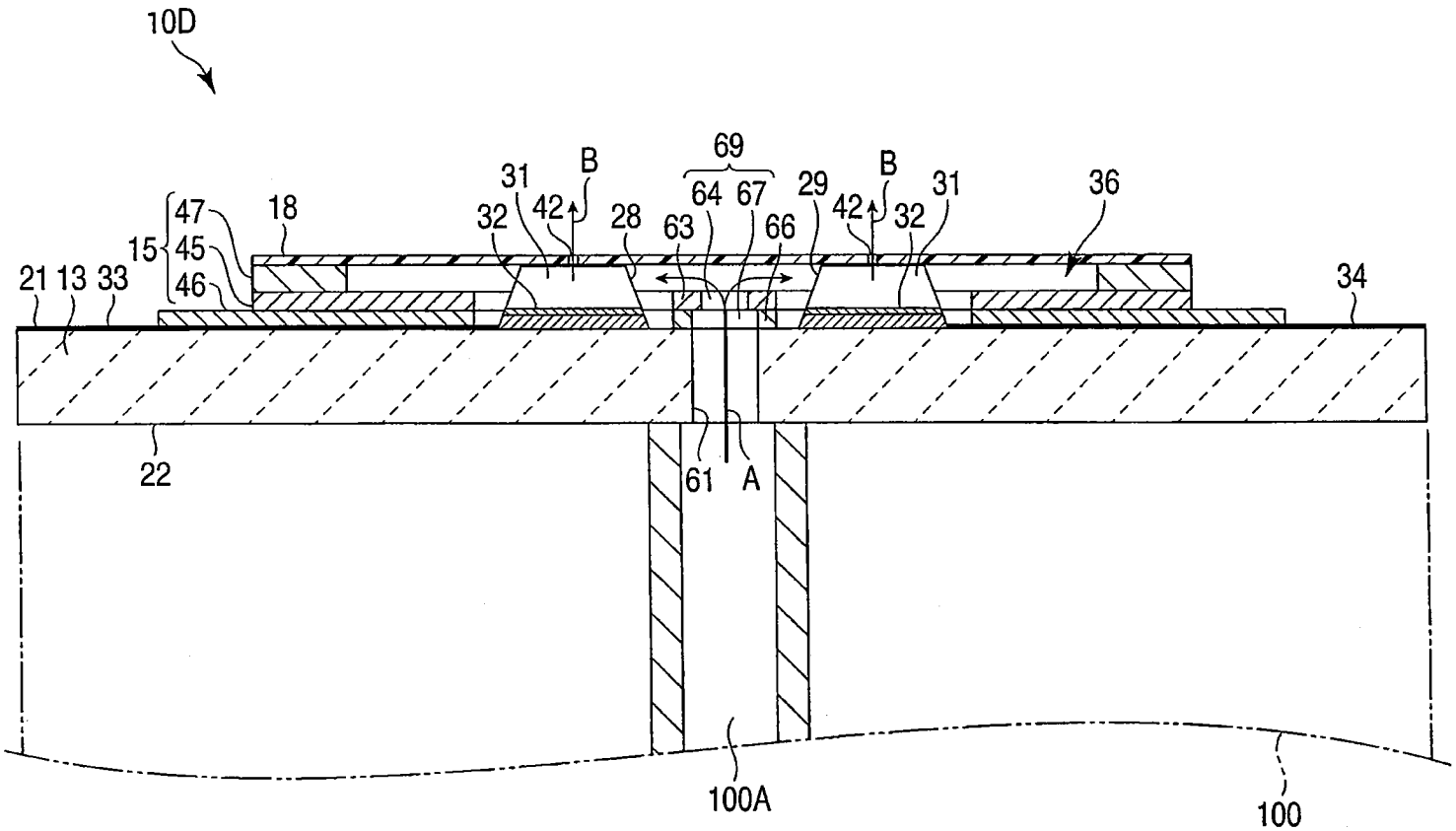
FIG. 13 is a cross-sectional view of the inkjet head of the fourth embodiment, taken along line F13-F13 of FIG. 12.

FIG. 12 is an exploded perspective view of an inkjet head 10D according to the fourth embodiment. FIG. 13 is a cross-sectional view of the inkjet head 10D, taken along line F13-F13 of FIG. 12. The inkjet head 10D is an inkjet head of a method of using up the supplied ink.

As illustrated in FIG. 12, a substrate 13 comprises only one supply port 61. As indicated by arrow A of FIG. 13, ink of an ink tank is supplied into an ink chamber 36 through a second branch channel 69 from the supply port 61. As indicated by arrow B of FIG. 13, the ink supplied to the ink chamber 36 is ejected from a plurality of nozzles 42 by a plurality of groove parts 31.

According to the inkjet head 10D having the above structure, the number of holes provided in the substrate 13 is reduced, and thereby the inkjet head 10D is easily manufactured.

In addition, a plurality of third opening parts 64 corresponding to the groove parts 31 are opened to the ink chamber 36. Thereby, ink is uniformly flows into the groove parts 31, and unevenness in density in printing is prevented.

Next, a fifth embodiment will be explained hereinafter with reference to FIG. 14 and FIG. 15. Constituent elements which have the same function as the inkjet head 10 of the first embodiment are denoted by the same respective reference numerals as those of the first embodiment, and explanation thereof is omitted.

Figure 14:
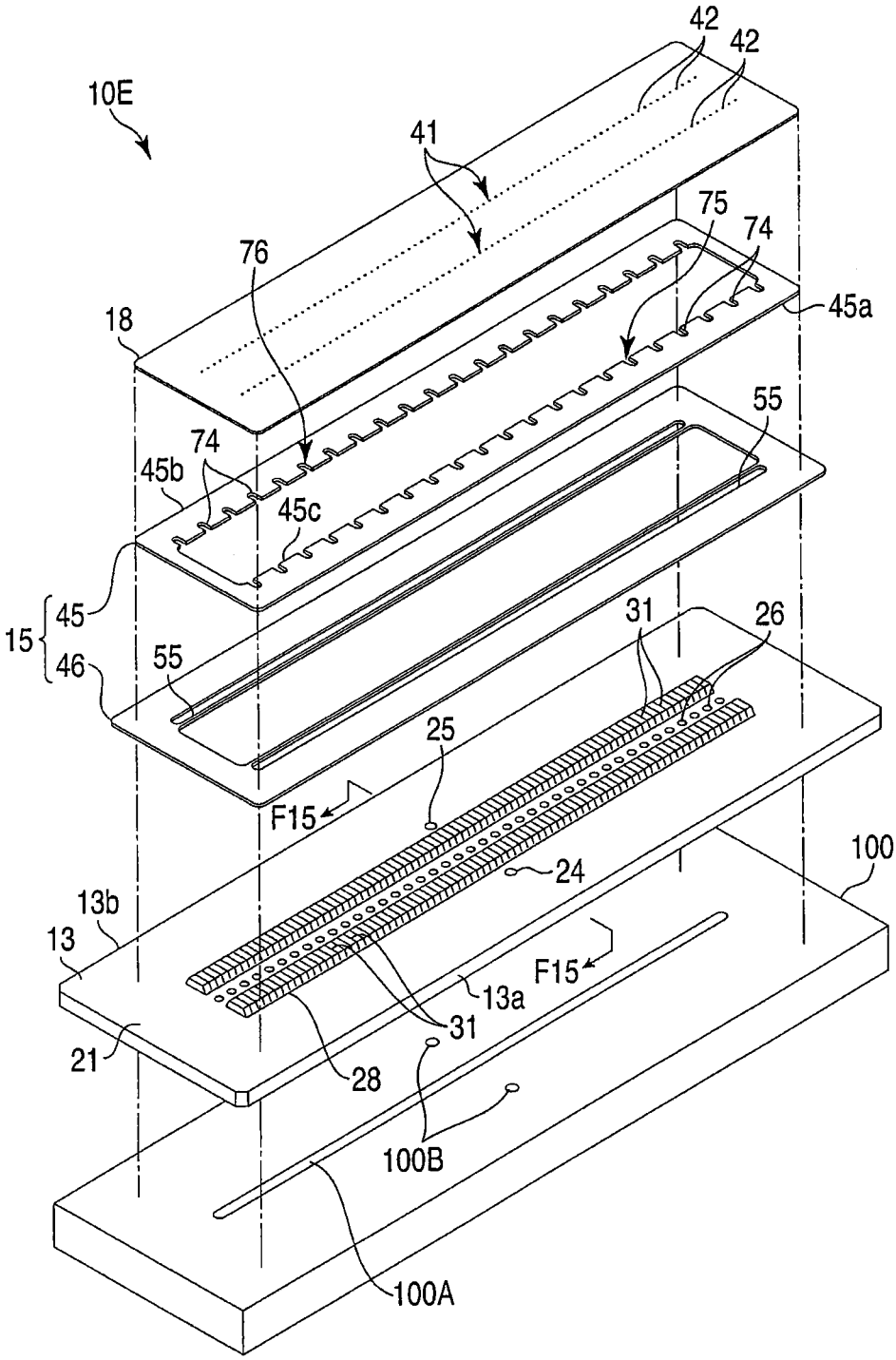
FIG. 14 is an exploded perspective view of an inkjet head according to a fifth embodiment.
Figure 15:
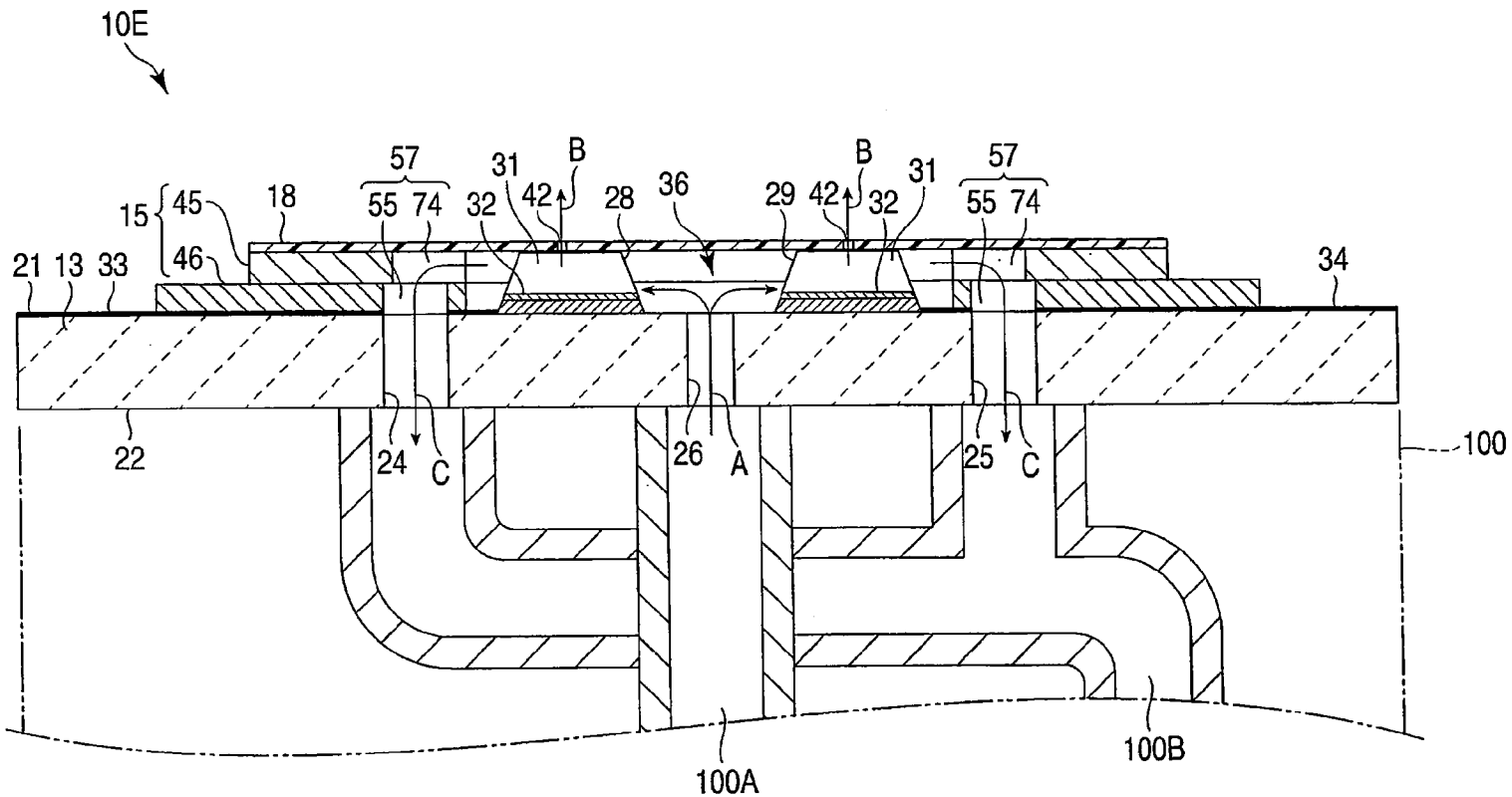
FIG. 15 is a cross-sectional view of the inkjet head of the fifth embodiment, taken along line F15-F15 of FIG. 14.

FIG. 14 is an exploded perspective view of an inkjet head 10E according to the fifth embodiment. FIG. 15 is a cross-sectional view of the inkjet head 10E, taken along line F15-F15 of FIG. 14. As illustrated in FIG. 14, a frame-like member 15 comprises just a first plate 45 and a second plate 46.

The first plate 45 is bonded to the second plate 46 to form the frame-like member 15. The first plate 45 is bonded to a nozzle plate 18. The second plate 46 is bonded to a substrate 13.

The first plate 45 comprises a plurality of first opening parts 74. The first opening parts 74 are arranged in two lines, and form a first opening line 75 and a second opening line 76. The first opening line 75 is provided along one side edge 45*a* of the first plate 45. The second opening line 76 is provided along the other side edge 45*b* of the first plate 45.

Each of the first opening parts 74 is formed in a notch shape which gets inside from an internal edge 45*c* of the first plate 45. As illustrated in FIG. 15, the first opening parts 74 communicate with an ink chamber 36.

In the first opening line 75, each first opening part 74 is provided to correspond to, for example, twenty groove parts 31 of a first piezoelectric member 28. In the second opening line 76, each first opening part 74 is provided to correspond to, for example twenty groove parts 31 of a second piezoelectric member 29.

The first opening parts 74 and a pair of second opening parts 55 form a pair of first branch channels 57 inside the frame-like member 15. In other words, the first opening parts 74 and a pair of second opening parts 55 form a pair of first branch channels 57 within a range of the thickness of the frame-like member 15. The first branch channels 57 is provided in the frame-like member 15, and include the first opening parts 74 and the second opening parts 55.

According to the inkjet head 10E having the above structure, the frame-like member 15 can be formed by two members, and the number of parts is reduced. Thereby, the inkjet head 10E is easily manufactured.

As described above, the first opening parts are not limited to through holes like the first opening parts 51 of the first embodiment, but can have various shapes. The notch-shaped first opening parts 74 of the fifth embodiment are also applicable to the first to fourth embodiments.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the frame-like member may be formed as one unitary piece by casting or injection molding such as insert molding. In addition, the driving elements may have a mechanism of generating bubbles for ink ejection driving.

What is claimed is:

1. An inkjet head comprising:

a nozzle plate which comprises a plurality of nozzles;

a base member which comprises a plurality of driving elements that cause the ink to be ejected from the nozzles, and is opposed to the nozzle plate;

a frame-like member which is interposed between the nozzle plate and the base member, the frame-like member comprising a plurality of first opening parts and a second opening part which extends over all the first opening parts;

an ink chamber which is provided inside the frame-like member and communicates with the first opening parts;

a supply channel which is provided in the base member and communicates with the ink chamber to supply ink; and a discharge channel which is provided in the base member and communicates with the ink chamber to discharge ink, the discharge channel being connected to the first opening parts through the second opening parts.

2. The inkjet head of claim 1, wherein the frame-like member comprises a frame-shaped first plate which comprises the first opening parts, and a frame-shaped second plate which comprises the second opening part and united with the first plate.

3. The inkjet head of claim 2, wherein the frame-like member comprises a spacer, which is interposed between the first plate and the nozzle plate and formed thicker than the first plate and thicker than the second plate.

4. The inkjet head of claim 2, wherein each of the first opening parts is formed in a notch shape which comes inside from an internal edge of the first plate.

5. The inkjet head of claim 2, wherein the frame-like member comprises a plurality of third opening parts which communicate with the ink chamber to correspond to the driving elements, and a fourth opening part which extends over all the third opening parts and connects the third opening parts with the supply channel.

6. The inkjet head of claim 5, wherein the first plate comprises the third opening parts, and the second plate comprises the fourth opening part.

7. The inkjet head of claim 6, wherein the frame-like member comprises a spacer, which is interposed between the first plate and the nozzle plate and formed thicker than the first plate and thicker than the second plate.

8. The inkjet head of claim 1, wherein the frame-like member comprises a plurality of third opening parts which communicate with the ink chamber to correspond to the driving elements, and a fourth opening part which extends over all the third opening parts and connects the third opening parts with the supply channel.

9. An inkjet head comprising:

a nozzle plate which comprises a plurality of nozzles;

a base member which comprises a plurality of driving elements that cause the ink to be ejected from the nozzles, and is opposed to the nozzle plate;

a frame-like member which is interposed between the nozzle plate and the base member, the frame-like member comprising a plurality of third opening parts corresponding to the driving elements, and a fourth opening part which extends over all the third opening parts;

an ink chamber which is provided inside the frame-like member and communicates with the third opening parts; and a supply channel which is provided in the base member and communicates with the ink chamber to supply ink, the supply channel being connected to the third opening parts through the fourth opening part.

10. The inkjet head of claim 9, wherein the frame-like member comprises a frame-shaped first plate which comprises the third opening parts, and a frame-shaped second plate which comprises the fourth opening part and united with the first plate.

11. The inkjet head of claim 10, wherein the frame-like member comprises a spacer, which is interposed between the first plate and the nozzle plate and formed thicker than the first plate and thicker than the second plate.

12. The inkjet head of claim 10, further comprising:

a discharge channel which is provided in the base member and communicates with the ink chamber to discharge ink, wherein the frame-like member comprises a plurality of first opening parts which communicate with the ink chamber, and a second opening part which extends over all the first opening parts and connects the first opening parts with the discharge channel.

13. The inkjet head of claim 12, wherein the frame-like member comprises a spacer, which is interposed between the first plate and the nozzle plate and formed thicker than the first plate and thicker than the second plate.

14. A method of manufacturing an inkjet head including:

a nozzle plate which comprises a plurality of nozzles;

a base member which comprises a plurality of driving elements that cause the ink to be ejected from the nozzles, and is opposed to the nozzle plate;

a frame-like member which is interposed between the nozzle plate and the base member, the frame-like member comprising a plurality of first opening parts correspond to the driving elements, and a second opening part which extends over all the first opening parts;

an ink chamber which is provided inside the frame-like member and communicates with the first opening parts;

a supply channel which is provided in the base member and communicates with the ink chamber to supply ink; and a discharge channel which is provided in the base member and communicates with the ink chamber to discharge ink, the discharge channel being connected to the first opening parts through the second opening part, the method comprising:

forming the frame-like member by uniting a frame-shaped first plate which comprises the first opening parts with a frame-shaped second plate which comprises the second opening part.

15. The method of claim 14, wherein the frame-like member comprises a spacer, which is formed thicker than the first plate and thicker than the second plate, further comprising:

bonding the spacer to the first plate which is bonded to the second plate; and interposing the spacer between the nozzle plate and the first plate, by attaching the nozzle plate to the spacer of the frame-like member.

16. The method of claim 14, wherein the bonding of the first plate to the second plate is performed by vacuum bonding.

* * * * *